US010670238B2

(12) United States Patent
Shih

(10) Patent No.: US 10,670,238 B2
(45) Date of Patent: Jun. 2, 2020

(54) MAGNETIC MODULE FOR LIGHT FIXTURES

(71) Applicant: Dongguan Zhao He Lighting Co., Ltd., Dongguan, Guangdong Province (CN)

(72) Inventor: Ming Feng Shih, Dongguan (CN)

(73) Assignee: Dongguan Zhao He Lighting Co., Ltd., Dongguan (CN)

( * ) Notice: Subject to any disclaimer, the term of this patent is extended or adjusted under 35 U.S.C. 154(b) by 83 days.

(21) Appl. No.: 16/158,249

(22) Filed: Oct. 11, 2018

(65) Prior Publication Data

US 2019/0277479 A1 Sep. 12, 2019

(30) Foreign Application Priority Data

Mar. 8, 2018 (CN) ..... 2018 2 0317887 U

(51) Int. Cl.

| | |
|---|---|
| ***F21V 17/10*** | (2006.01) |
| ***F21V 7/04*** | (2006.01) |
| ***F21V 21/03*** | (2006.01) |
| ***F21V 29/77*** | (2015.01) |
| ***F21V 5/04*** | (2006.01) |

(52) U.S. Cl.

CPC ..... *F21V 17/105* (2013.01); *F21V 5/04* (2013.01); *F21V 7/04* (2013.01); *F21V 21/03* (2013.01); *F21V 29/773* (2015.01)

(58) Field of Classification Search

CPC ..... F21V 17/105; F21V 21/03; F21V 29/773; F21V 5/04; F21V 7/04; F21V 17/002; F21V 11/08; F21V 9/00; F21V 7/00

See application file for complete search history.

(56) References Cited

U.S. PATENT DOCUMENTS

| | | | | |
|---|---|---|---|---|
| 10,295,161 | B1 * | 5/2019 | Shih | F21V 21/15 |
| 2013/0044501 | A1 * | 2/2013 | Rudisill | F21V 29/70 362/398 |
| 2014/0063812 | A1 * | 3/2014 | Geralds | F21S 8/026 362/296.01 |
| 2015/0362159 | A1 * | 12/2015 | Ludyjan | F21V 23/06 362/277 |
| 2018/0058676 | A1 * | 3/2018 | Huang | F21V 23/005 |
| 2018/0195678 | A1 * | 7/2018 | Hawthorne | F21S 8/061 |

* cited by examiner

*Primary Examiner* — Tracie Y Green

(74) *Attorney, Agent, or Firm* — Lightbulb IP, LLC

(57) ABSTRACT

A magnetic module includes a circular truncated cone reflector. There is a mounting area on the top of the reflector, and the lens which filtrates the light from the LED and an optional honey comb installed at the mounting area. One or more pillars are around the circular truncated cone reflector. There is a mounting hole on the top of each pillar and a magnet on each mounting hole. The circular truncated cone reflector connects with a LED lighting front ring. The LED lighting front ring covers the circular truncated cone reflector, and the magnetic material of the LED lighting front ring and the magnet come together. The magnetic module is easy to install and replace because of the magnetic elements. The invention may be incorporated into a pendant, down light, or track light.

10 Claims, 8 Drawing Sheets

MAGNETIC MODULE FOR LIGHT FIXTURES

CROSS-REFERENCE TO RELATED APPLICATION

This application claims priority to China Patent Application No. 201820317887.0, filed Mar. 8, 2018

BACKGROUND OF THE INVENTION

Field of the Invention

The invention relates to LED lighting and in particular to a magnetic module for a pendant, down light, and track light.

Related Art

Energy conservation and renewable energy are a trend for modern industry. LED lighting is generally the first choice for lighting because of energy conservation. Pendant, down lights, track lights, and spot lights are popular fixture types for LED lighting. LED lighting conserves energy and provides good lighting effects for the residential, shop, architecture, and outdoor applications.

From the discussion that follows, it will become apparent that the present invention addresses the deficiencies associated with the prior art while providing numerous additional advantages and benefits not contemplated or possible with prior art constructions.

SUMMARY OF THE INVENTION

Different environments or applications need different luminous flux and color of the LED fixture. Therefore, manufacturers need to produce different models of LED fixtures in order to match varying demands. However, the assembly of LED fixtures is hard and complex during the production process.

In order to solve the above drawbacks of current LED fixtures, we provide a magnetic module for pendant, down lights, and track lights. The magnetic module improves the assembly and replacement efficiency for pendant, down lights, and track lights.

In order to solve the above technical issues, a magnetic module for LED fixtures is disclosed herein. In one exemplary embodiment, the magnetic module includes a circular truncated cone reflector. There is a mounting area on the top of the reflector, and the lens which filtrates the light from the LED and honey comb (optional) are installed on this mounting area. There are some pillars around the circular truncated cone reflector. There is a mounting hole on the top of each pillar. There is a magnet on each of the mounting holes. The circular truncated cone reflector connects with the LED lighting's front ring. The LED lighting front ring (which is typically iron) covers on the circular truncated cone reflector, and the magnetic material of the front ring and the magnet come together. This magnetic module (001) can be installed on LED lighting easily.

Additionally, regarding the above, there are four pillars around the reflector, and the four pillars and this reflector are a one-piece structure. The material of the reflector is polycarbonate, the material of the lens is polycarbonate.

The benefits of this magnetic module include easy installation and replacement. In addition, different demands or requirements for LED fixtures can be met since there are different specifications for the lens and anti-glare reflectors in the magnetic module.

In a second exemplary embodiment, a pendant including a ceiling box is disclosed. There is an installation bracket on the top of the ceiling box. There is a stem on the bottom of the ceiling box. The stem is fastened on the installation plate of circular pillar, and the installation plate of circular pillar is on the opposite side of the ceiling box. There is an area on the installation plate of circular pillar where a lighting module is placed. The lighting module connects with the magnetic module which is described above. The magnetic module and the front ring of the pendant come together.

Additionally, the lighting module includes the heat sink LED holder, and lens (from up to down). The lens installs on the front ring. The LED holder is placed on the lens. The LED is mounted on the LED holder. The heat sink is fastened with the installation plate through the screws. The front ring is fastened with the installation plate, the heat sink is fastened with the installation plate through the screws. There is an installation area between the heat sink and the front ring, putting and fastening the lens, LED holder, LED in the installation area.

In a third exemplary embodiment, a kind of the down light including an installation plate is disclosed. There are one or more spot light modules on the installation plate. There is one spring clip on the left side of the installation plate and there is one spring clip on the right side of the installation plate. There is a fixing circular pillar on the upper of the installation plate for each spot light module. There is an installing circular pillar on the bottom of the installation plate for each spot light module. There is a fixing rear cap inside the fixing circular pillar. The fixing rear cap connects the heat sink through the rotation bracket and the U-shape bracket. The heat sink is fixed on the installing circular pillar through screws, then the installing circular pillar link with the installation plate and the fixing circular pillar. The lighting module is in the installing circular pillar for each spot light. The magnetic module (001) and the front ring come together.

Additionally, the lighting module includes a LED holder, lens, LED, and heat sink. The lens is fixed on the front ring. The LED holder is placed on the lens. The LED is mounted on the LED holder. The heat sink and the front ring fasten the lens, LED, and LED holder.

In a fourth exemplary embodiment, a track light including a track box is disclosed. There is an installation circular pillar under the track box. There is a rotation bracket inside the empty area of the installation circular pillar. The rotation bracket connects with the track box. There is a U-shaped bracket on the rotation bracket (the opposite side of the track box). The U-shaped bracket connects with the heat sink which inside the installation circular pillar. The heat sink is fixed on the installation circular pillar through screws that allow the installation circular pillar link with the track box. There is a lighting module inside the installation circular pillar. The magnetic module (001) and the front ring come together.

Additionally, the lighting module includes the heat sink, LED, LED holder, and lens. The lens is fixed on the front ring. The LED holder is placed on the lens. The LED is mounted on the LED holder. The heat sink and the front ring fasten the lens, LED holder, and the LED.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The description through the words and drawings of this application are for the explanation of the present invention, rather than a limitation of the innovations herein. The words "center," "longitudinal," "transverse," "length," "width," "thickness," "up," "down," "forward," "back," "left," "right," "vertical," "horizontal," "top," "bottom," "inside," "outside," "clockwise," and "counterclockwise" are for purposes of explanation, rather than limiting the associated devices and components to a specific position or direction and operation by a specific position or direction. Therefore, these words cannot be realized as a limitation of this application.

The words "first" and "second" are only for description purposes, and not for the relative importance or a specification of quantity. Except as otherwise specified in the description, the words "some" and "many" mean two or more than two. Except as otherwise specified in the description, the words "installation," "link," "connection," and "fasten" should be interpreted broadly, such as, a connection can be a fixed connection, removable connection, or one-piece connection. The connection can be a mechanical connection, or an electronic connection. The link can be a direct link, the link through other things, or the internal link between two components. A person of ordinary skill will understand the meaning of these words in the context of the present disclosure.

A first specification of "up" or "down" relative to a second specification includes these two specifications connecting directly or connecting through other elements between them. A first specification of "up" or "top" relative to a second specification means the first specification is right above or inclined above the second specification, or the first specification horizontal altitude is higher than the second specification horizontal altitude. A first specification of "down" or "bottom" relative to a second specification means the first specification is right below or inclined below the second specification, or the first specification horizontal altitude is lower than the second specification horizontal altitude. Though disclosed herein with reference to one or more implementations or embodiments, it will be understood that various elements of one implementation or embodiment can be used with another implementation or embodiment.

Figure 1:
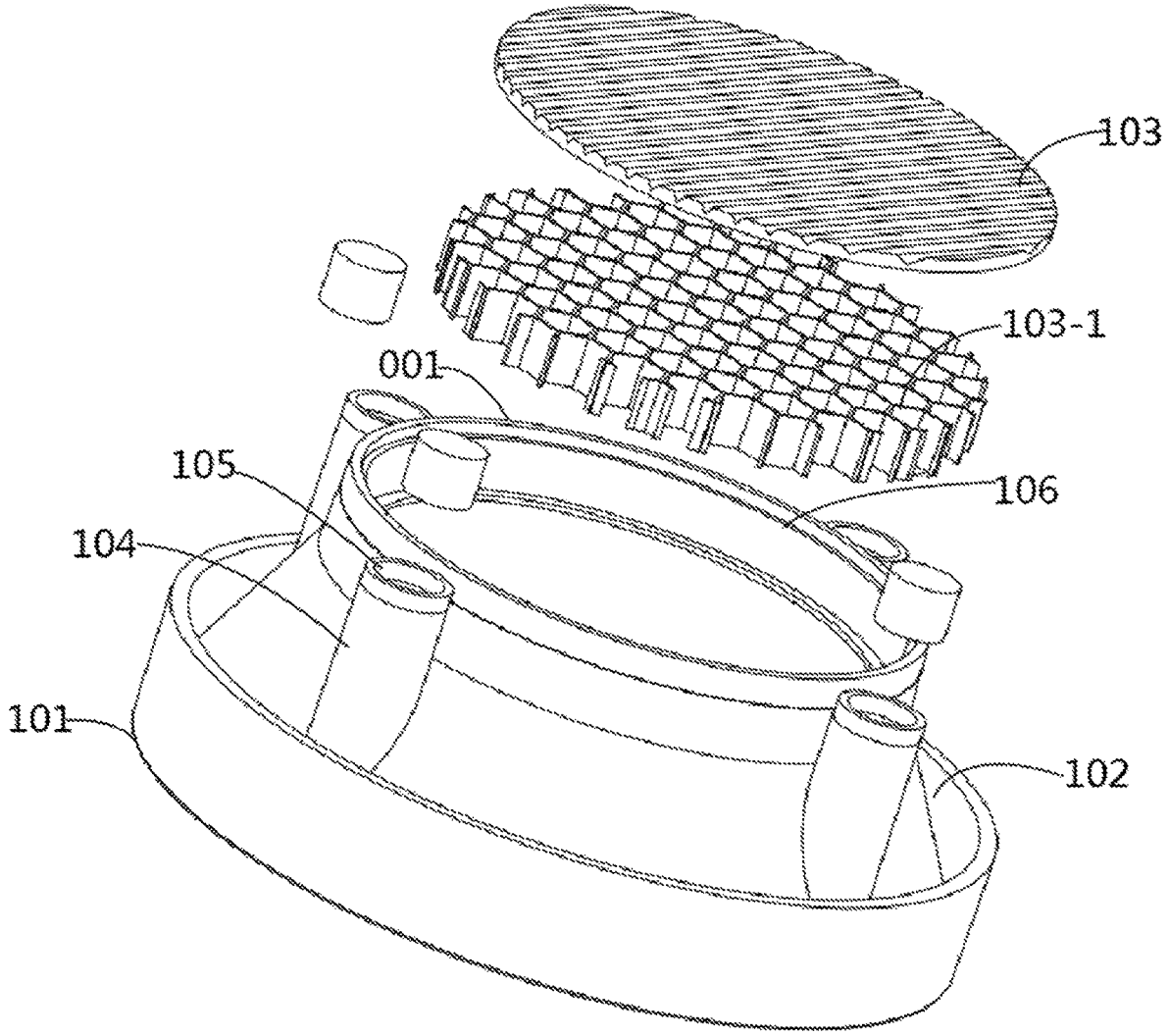
FIG. 1 is an exploded view of an exemplary magnetic module.
Figure 2:
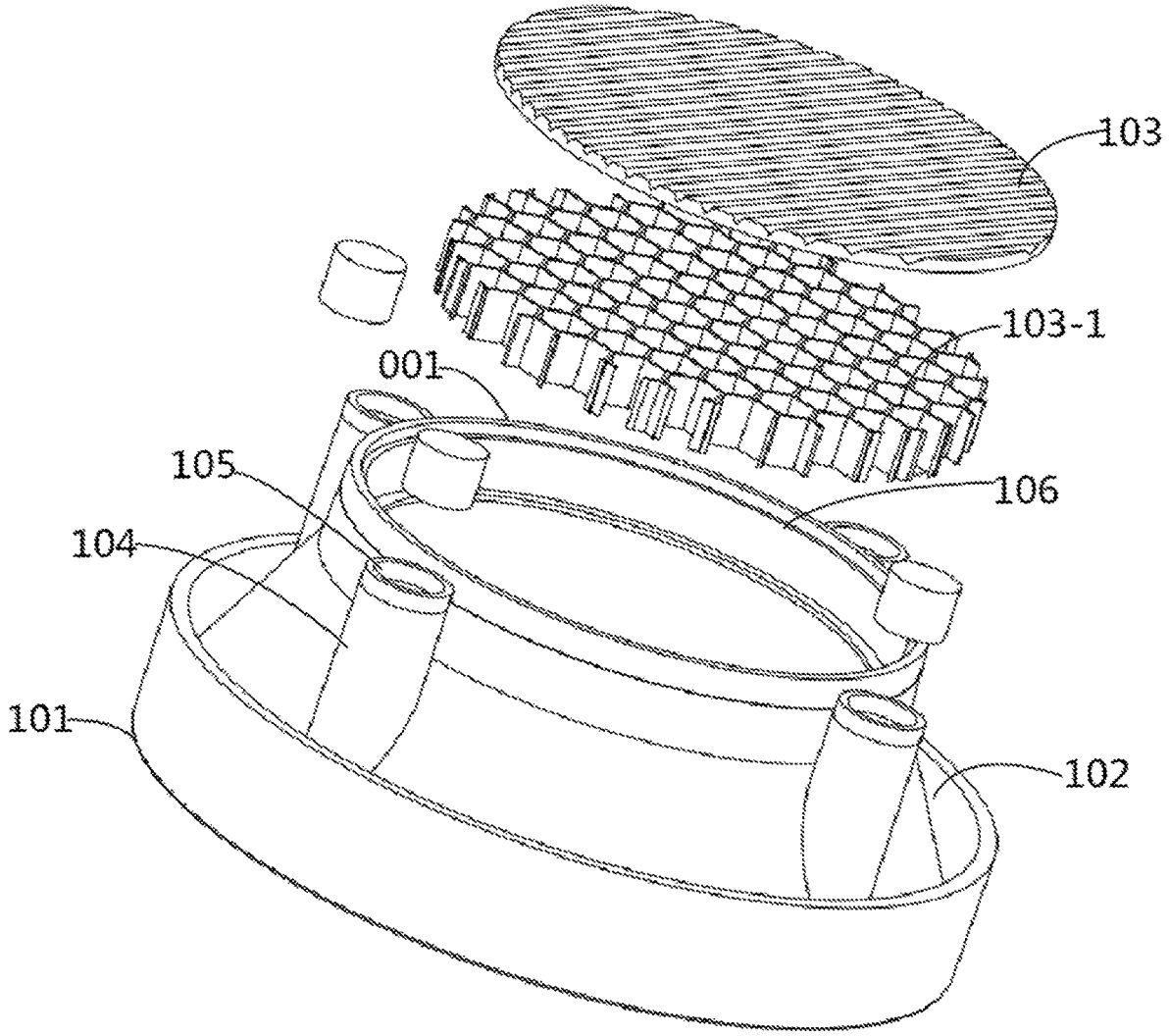
FIG. 2 is an exploded view of the exemplary magnetic module of FIG. 1.

Implementation 1:

Referring to FIGS. 1 and 2, a magnetic module (001) for LED lighting includes a circular truncated cone reflector (101). There is a mounting area (102) around the top of this reflector. The lens (103) which filtrates the light from the LED lighting and the honey comb (103-1, optional) are mounted on the mounting area (102). There are some pillars (104) around the circular truncated cone reflector (101). There is a mounting hole (105) on the top of each pillar (104). There is a magnet (106) on each of the mounting hole (105). The circular truncated cone reflector (101) connects with the LED lighting front ring (107). The LED lighting front ring (107) (material is typically iron) covers on the circular truncated cone reflector (101), and the magnetic material of the LED lighting front ring (107) and the magnet (106) come together. This magnetic module (001) can be installed on the LED lighting easily.

There are four pillars (104) around the reflector (101), and the four pillars (104) and this reflector (101) are a one-piece structure. The material of the reflector (101) is polycarbonate, the material of the lens is polycarbonate, the shape of the magnet (106) is circular.

This magnetic module (001) of the LED lighting can be easy replacement. There are different specifications of the lens and anti-glare reflector in order to match different demands of the LED lighting.

Figure 3:
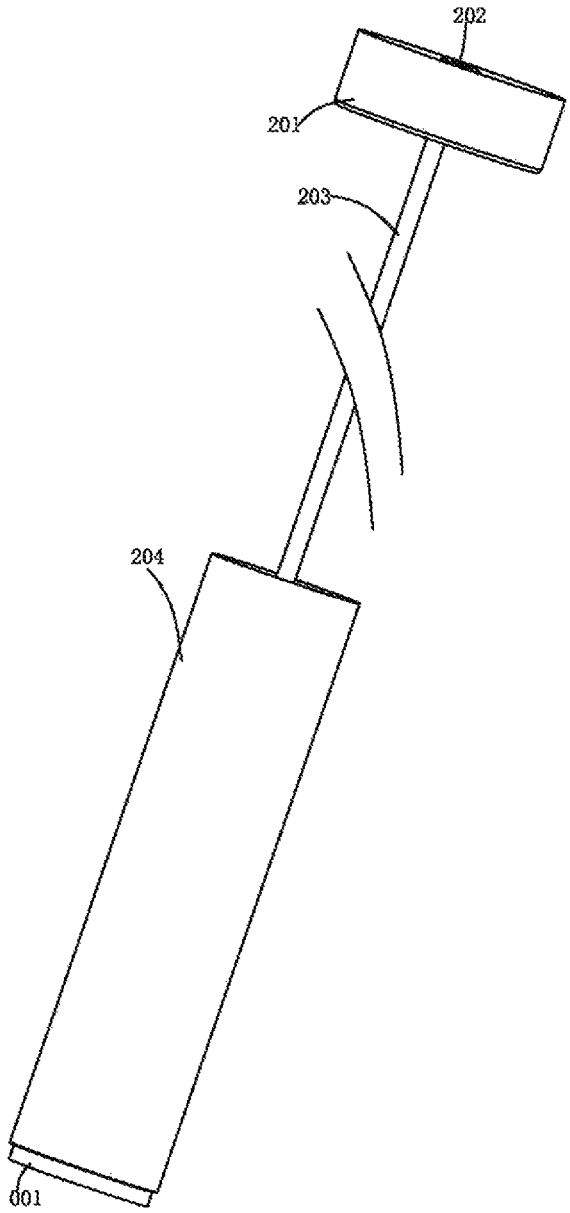
FIG. 3 is a perspective view of an exemplary pendant.
Figure 4:
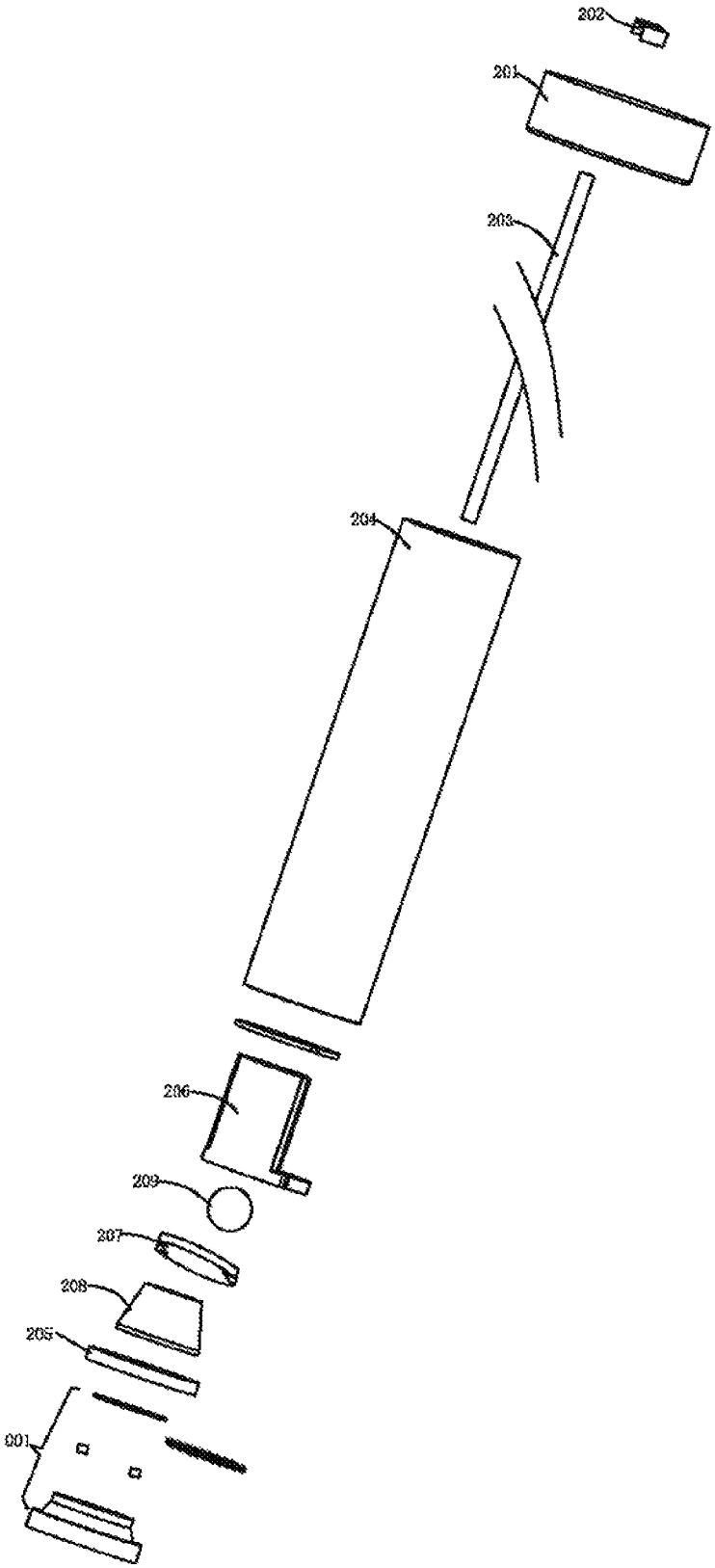
FIG. 4 is an exploded view of the exemplary pendant of FIG. 3.

Implementation 2:

Referring to FIGS. 3 and 4, a pendant includes a ceiling box (201). There is an installation bracket (202) on the top of the ceiling box (201). There is a stem (203) on the bottom of the ceiling box (201). The stem (203) fastens the installation plate of circular pillar (204), and the installation plate of circular pillar (204) is on the opposite side of the ceiling box (201). There is an area on the installation plate of circular pillar (204) (not shown) and there is a lighting module on this area. The lighting module connects with the magnetic module (001) which is mentioned with regard to Implementation 1 above. The magnetic module (001) and the front ring (205) of the pendant come together.

The lighting module includes the heat sink (206) LED holder (207), and lens (208) (from up/top to down/bottom). The preferred material of the heat sink (206) is aluminum. The preferred material of the lens is polycarbonate. The lens (208) installs on the front ring (205). The LED holder (207) is placed on the lens (208). The LED (209) is mounted on the LED holder (207). The heat sink (206) is fastened with the installation plate (204) through the screws. The front ring (205) is fastened with the installation plate (204), the heat sink (206) is fastened with the installation plate (204) through the screws, and there is an installation area between the heat sink (206) and the front ring (205). Putting and fastening the lens (208), LED holder (207), and LED (209) in the installation area.

Figure 5:
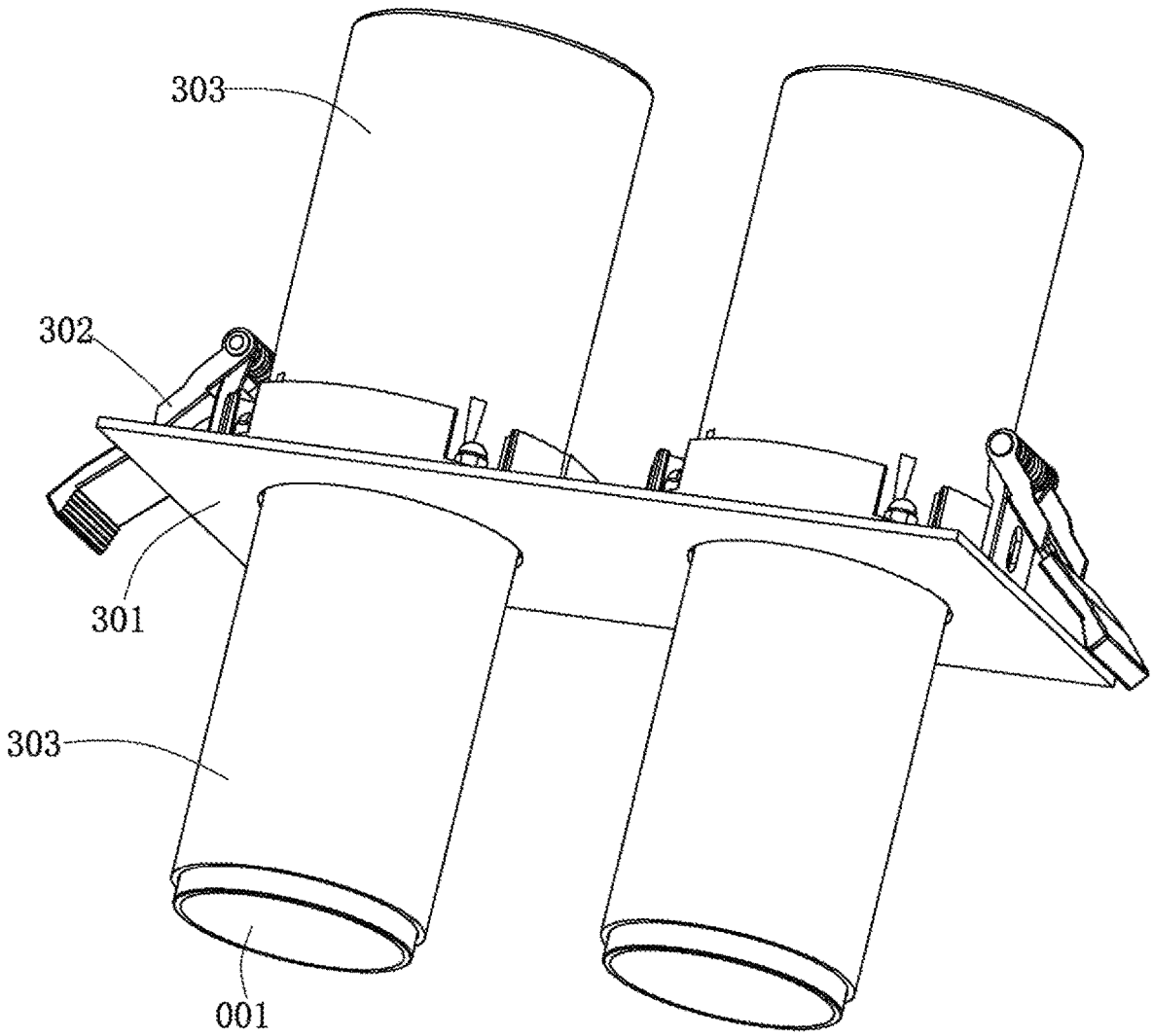
FIG. 5 is a perspective view of an exemplary down light.
Figure 6:
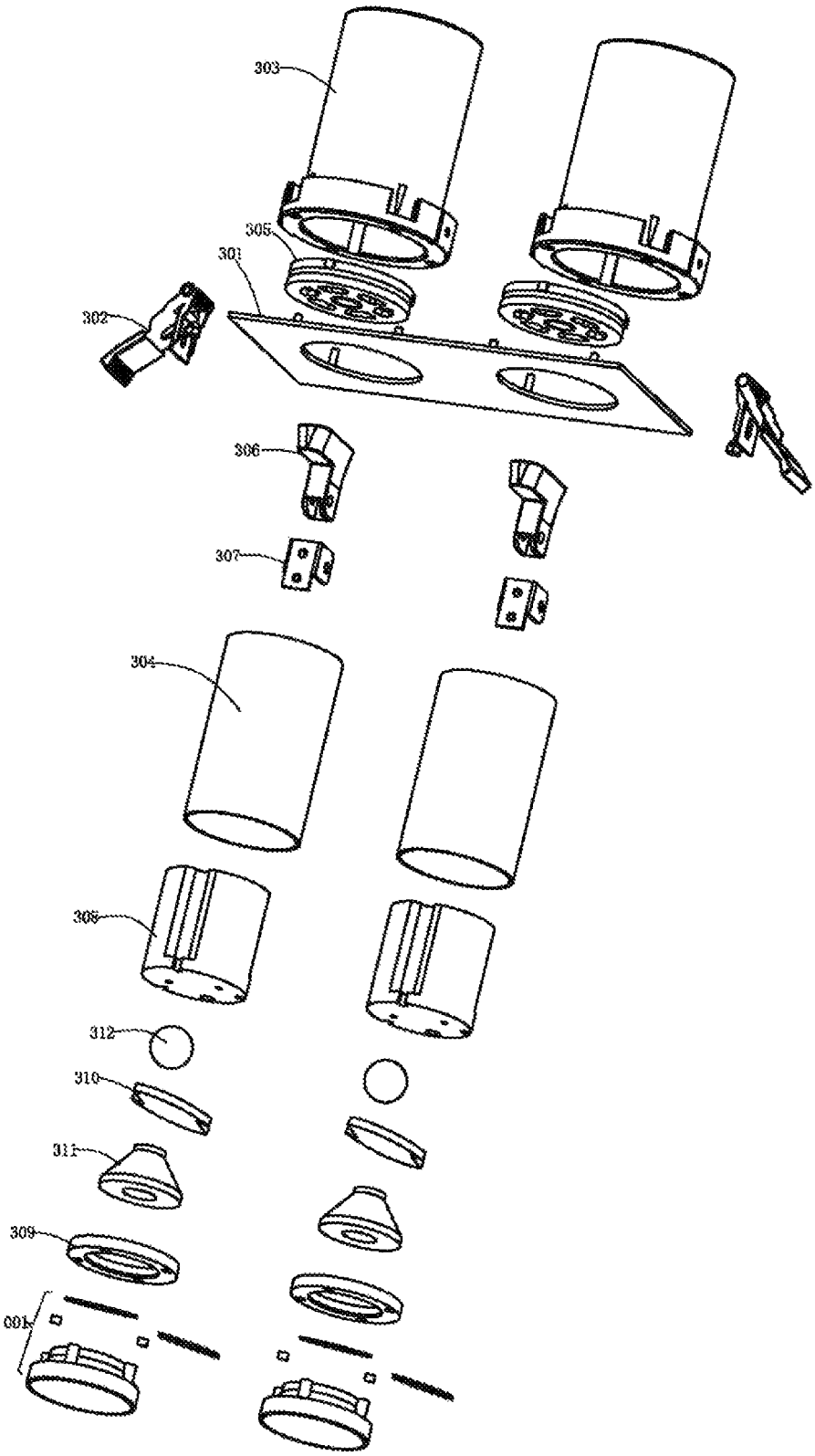
FIG. 6 is an exploded view of the exemplary down light of FIG. 5.

Implementation 3:

Referring to FIGS. 5 and 6, a kind of down light includes an installation plate (301). There are one or more spot light modules on the installation plate (301). There is one spring clip on the left side of the installation plate (301) and there is one spring clip on the right side of the installation plate (301). There is a fixing circular pillar (303) on the upper of the installation plate (301) for each spot light module. There is an installing circular pillar (304) on the bottom of the installation plate (301) for each spot light module. There is a fixing rear cap (305) inside the fixing circular pillar (303). The fixing rear cap (305) connects the heat sink (308) through the rotation bracket (306) and the U-shaped bracket (307). The heat sink (308) is fixed on the installing circular pillar (304) through screws. In this manner, the installing circular pillar (304) links with the installation plate (301) and the fixing circular pillar (303). The lighting module is in the installing circular pillar (304) for each spot light. The magnetic module (001) and the front ring (309) come together.

In this case, there are two spot lights on the installation plate (301). Each spot light includes a lighting module. The lighting module includes a LED holder (310), lens (311), LED (312), and heat sink (308). The preferred material of the heat sink (308) is aluminum. The preferred material of the LED holder (310) is polycarbonate. The preferred material of the lens (311) is polycarbonate. The lens (311) is fixed on the front ring (309). The LED holder (310) is placed on the lens (311). The LED (312) is mounted on the LED holder (310). The heat sink (308) and the front ring (309) fasten the lens (311), LED (312), and LED holder (310), such as according to the fastening method disclosed in the relevant description of Implementation 2 above.

Implementation 4

Figure 7:
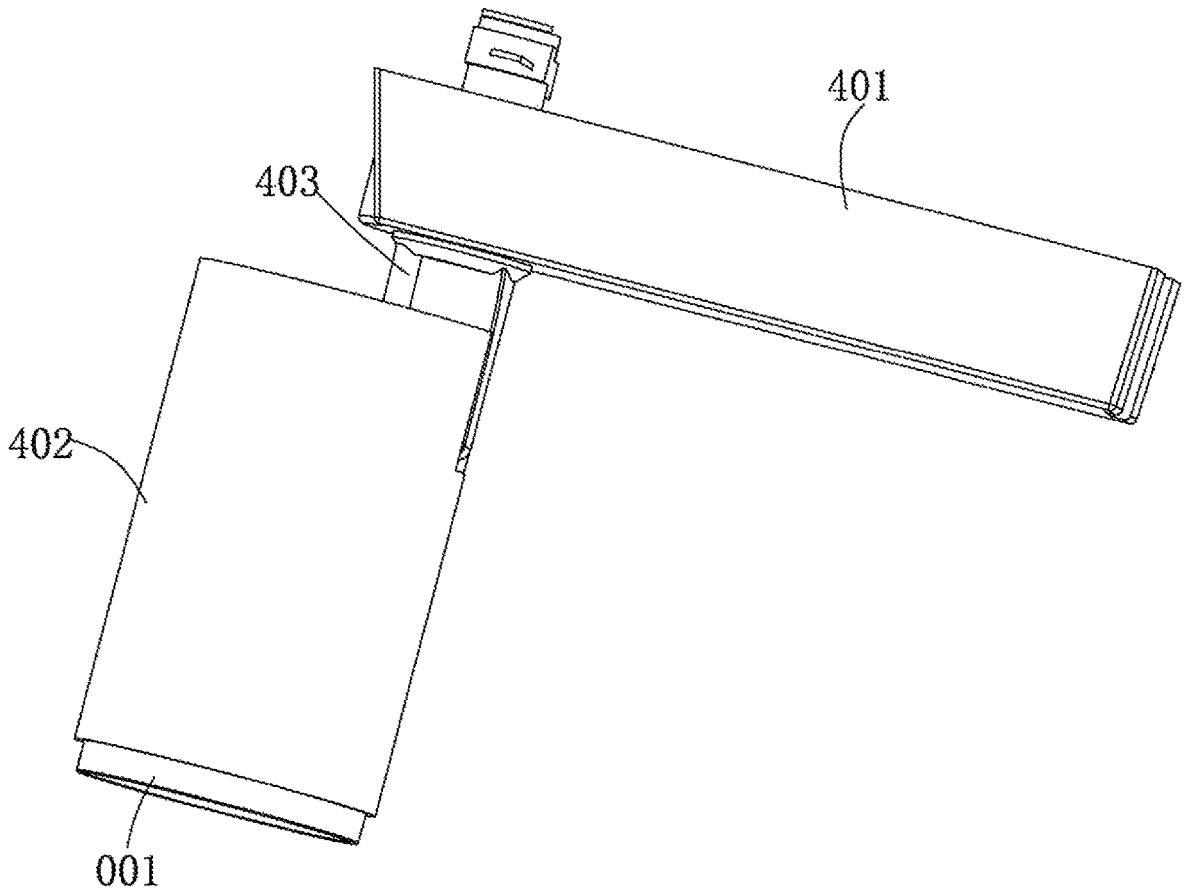
FIG. 7 is a perspective view of an exemplary track light.
Figure 8:
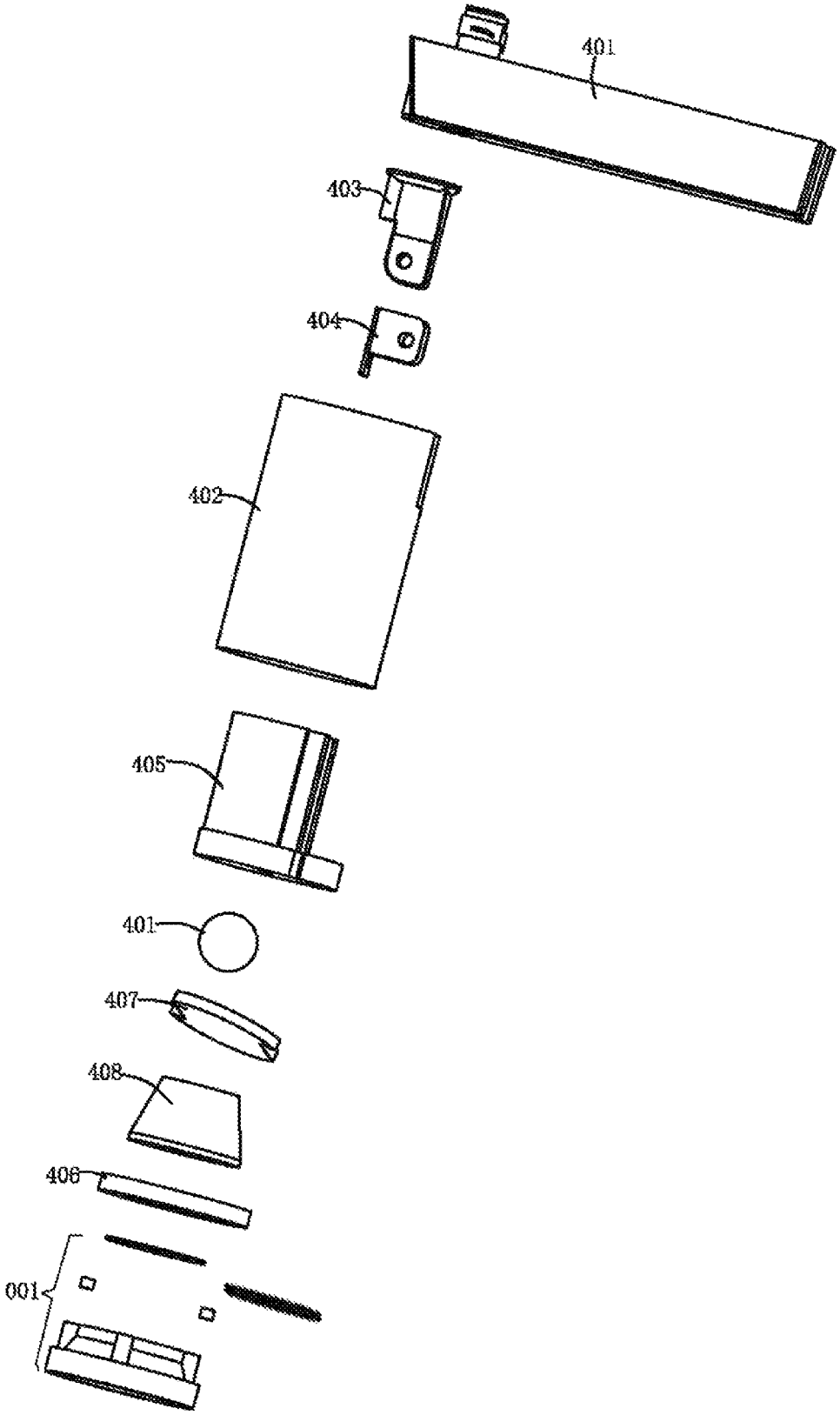
FIG. 8 is an exploded view of the exemplary track light of FIG. 7.

Referring to FIGS. 7 and 8, a track light includes a track box (401). There is an installation circular pillar (402) under the track box (401). There is a rotation bracket (403) inside the empty area of the installation circular pillar (402). The rotation bracket connects with the track box (401). There is a U-shapes bracket (404) on the rotation bracket (403) (at the opposite side of the track box (401)). The U-shaped bracket (404) connects with the heat sink (405) which is inside the installation circular pillar (402). The heat sink (405) is fixed on the installation circular pillar (402) through screws which lets the installation circular pillar (402) link with the track box (401). There is a lighting module inside the installation circular pillar (402). The magnetic module (001) and the front ring (406) come together. The lighting module includes the heat sink (405), LED (409), LED holder (407), and lens (408). The preferred material of the heat sink (405) is aluminum. The preferred material of the LED holder (407) is polycarbonate. The preferred material of the lens (408) is polycarbonate. The lens (408) is fixed on the front ring (406). The LED holder (407) is placed on the lens (408). The LED (409) is mounted on the LED holder (407). The heat sink (405) and the front ring (406) fasten the lens (408), LED holder (407), and the LED (409), such as according to the fastening method disclosed in the relevant description of Implementation 2 above.

The above descriptions are not limitations on the scope of the invention, and any alterations or modifications according to the present disclosure are within the scope of the invention. While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A magnetic module for a LED fixture, the magnetic module comprising:

a circular truncated cone reflector having a mounting area at a top of the reflector and a front ring formed from a magnetic material that covers the circular truncated cone reflector;

a lens that filters the light from the LED fixture installed at the mounting area;

one or more pillars are around the circular truncated cone reflector, wherein a mounting hole is at a top of each of the one or more pillars; and a magnet at each mounting hole;

wherein the front ring and the magnet are attached via magnetic attraction between the front ring and the magnet.

2. The magnetic module of claim 1, wherein there are four pillars around the reflector, and the four pillars and the reflector are a one-piece structure.

3. The magnetic module of claim 1, wherein the circular truncated cone reflector is a polycarbonate anti-glare reflector.

4. The magnetic module of claim 1, wherein the lens is polycarbonate.

5. A pendant light fixture comprising:

a ceiling box having an installation bracket at a top of the ceiling box;

a stem at a bottom of the ceiling box;

a circular pillar having an installation plate and attached to the stem;

a lighting module attached to the installation plate; and a magnetic module comprising:

a circular truncated cone reflector having a front ring formed from a magnetic material that covers the circular truncated cone reflector;

one or more pillars are around the circular truncated cone reflector, wherein a mounting hole is at a top of each of the one or more pillars; and a magnet at each mounting hole;

wherein the front ring and the magnet are attached via magnetic attraction between the front ring and the magnet;

wherein the lighting module is connected to the magnetic module.

6. The pendant light fixture of claim 5, wherein the lighting module comprises:

a heat sink LED holder attached to the installation plate;

a lens attached to the front ring at a first end, wherein the heat sink LED holder is attached to a second end of the lens;

one or more LEDs mounted to the heat sink LED holder;

wherein the lens and the one or more LEDs are positioned between the heat sink and the front ring.

7. A down light fixture comprising:

an installation plate comprising one or more spot light modules;

one or more spring clips at the left side and the right side of the installation plate;

a fixing circular pillar at an upper end of the installation plate for each of the one or more spot light modules;

a fixing rear cap inside the fixing circular pillar;

an installing circular pillar at a bottom end of the installation plate for each of the one or more spot light modules;

a heat sink attached to the installing circular pillar, linking the installing circular pillar with the installation plate and the fixing circular pillar, wherein the fixing rear cap connects the heat sink through a rotation bracket and a U-shaped bracket;

a magnetic module for each of the one or more spot light modules comprising:

a circular truncated cone reflector having a front ring formed from a magnetic material that covers the circular truncated cone reflector;

one or more pillars are around the circular truncated cone reflector, wherein a mounting hole is at a top of each of the one or more pillars; and a magnet at each mounting hole;

wherein the front ring and the magnet are attached via magnetic attraction between the front ring and the magnet.

8. The down light fixture of claim 7, wherein the one or more spot light modules comprise:

a lens attached at a first end to the front ring;

a LED holder attached to a second end of the lens;

a LED mounted to the LED holder; and a heat sink, wherein the heat sink and the front ring fasten the lens and LED holder.

9. A track light fixture comprising:

a track light comprising a track box;

an installation circular pillar under the track box with a rotation bracket inside an empty portion of the installation circular pillar, wherein the rotation bracket is connected to the track box;

a heat sink inside the installation circular pillar with one or more fasteners, the one or more fasteners linking the installation circular pillar link with the track box a U-shaped bracket at the rotation bracket connected to the heat sink;

a lighting module inside the installation circular pillar; and a magnetic module comprising:

a circular truncated cone reflector having a front ring formed from a magnetic material that covers the circular truncated cone reflector;

one or more pillars are around the circular truncated cone reflector, wherein a mounting hole is at a top of each of the one or more pillars; and a magnet at each mounting hole;

wherein the front ring and the magnet are attached via magnetic attraction between the front ring and the magnet.

10. The track lighting fixture of claim 9, wherein the lighting module comprises:

a LED holder attached to the lens;

a LED mounted to the LED holder; and a lens fixed on the front ring;

wherein the heat sink and the front ring fasten the lens and the LED holder.

* * * * *